US009790749B2

(12) United States Patent
Chen

(10) Patent No.: US 9,790,749 B2
(45) Date of Patent: Oct. 17, 2017

(54) DOWNHOLE DRILLING TOOLS INCLUDING LOW FRICTION GAGE PADS WITH ROTATABLE BALLS POSITIONED THEREIN

(71) Applicant: Halliburton Energy Services, Inc., Houston, TX (US)

(72) Inventor: Shilin Chen, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/035,717

(22) PCT Filed: Dec. 13, 2013

(86) PCT No.: PCT/US2013/075043

§ 371 (c)(1),
(2) Date: May 10, 2016

(87) PCT Pub. No.: WO2015/088559

PCT Pub. Date: Jun. 18, 2015

(65) Prior Publication Data

US 2016/0290069 A1 Oct. 6, 2016

(51) Int. Cl.

| | |
|---|---|
| ***E21B 10/55*** | (2006.01) |
| ***E21B 10/60*** | (2006.01) |
| ***E21B 17/10*** | (2006.01) |
| ***E21B 12/04*** | (2006.01) |
| *E21B 10/54* | (2006.01) |

(52) U.S. Cl.

CPC ..... *E21B 17/1092* (2013.01); *E21B 10/55* (2013.01); *E21B 10/60* (2013.01); *E21B 12/04* (2013.01); *E21B 17/1078* (2013.01); *E21B 2010/545* (2013.01)

(58) Field of Classification Search

CPC .. E21B 17/1057; E21B 17/1092; E21B 10/43; E21B 10/55; E21B 10/60; E21B 12/04; E21B 17/1078

See application file for complete search history.

(56) References Cited

U.S. PATENT DOCUMENTS 4,220,213 A 9/1980 Hamilton
4,640,371 A * 2/1987 Moraly ..... B23B 51/0045 175/273

(Continued)

FOREIGN PATENT DOCUMENTS

CA 2439840 A1 3/2005
CN 201671547 12/2010

(Continued)

OTHER PUBLICATIONS

International Search Report and Written Opinion, Application No. PCT/US2013/075043; 10 pgs., Dec. 22, 2014.

*Primary Examiner* — Daniel P Stephenson
(74) *Attorney, Agent, or Firm* — Baker Botts L.L.P.

(57) ABSTRACT

In accordance with some embodiments, a downhole drilling tool comprises a bit body, a blade on an exterior portion of the bit body, and a gage pad on the blade. The gage pad includes a ball retainer and a ball located in the ball retainer such that an exposed portion of the ball is positioned to contact a wellbore and rotate in response to frictional engagement with the wellbore.

16 Claims, 7 Drawing Sheets

(56) References Cited

U.S. PATENT DOCUMENTS

| | | | | |
|---|---|---|---|---|
| 4,768,599 | A * | 9/1988 | Eischeid | B23B 31/08 175/263 |
| 4,842,083 | A | 6/1989 | Raney | |
| 5,109,935 | A | 5/1992 | Hawke | |
| 5,186,268 | A | 2/1993 | Clegg | |
| 5,339,910 | A | 8/1994 | Mueller | |
| 5,358,042 | A * | 10/1994 | Stoltz | E21B 17/1057 166/241.6 |
| 5,715,898 | A * | 2/1998 | Anderson | E21B 17/1057 175/323 |
| 5,967,247 | A | 10/1999 | Pessier | |
| 6,138,780 | A | 10/2000 | Beuershausen | |
| 8,733,455 | B2 * | 5/2014 | Shaikh | E21B 17/1057 166/241.6 |
| 2002/0020526 | A1 | 2/2002 | Male et al. | |
| 2002/0079139 | A1 | 6/2002 | Mensa-Wilmot et al. | |
| 2003/0159834 | A1 | 8/2003 | Kirk et al. | |
| 2007/0205024 | A1 | 9/2007 | Mensa-Wilmot | |
| 2007/0272445 | A1 | 11/2007 | Cariveau et al. | |
| 2010/0276138 | A1 * | 11/2010 | Wittman | E21B 17/1057 166/241.1 |
| 2011/0031025 | A1 | 2/2011 | Kulkarni | |
| 2011/0139508 | A1 | 6/2011 | Haugvaldstad et al. | |
| 2012/0111637 | A1 | 5/2012 | Chen et al. | |
| 2013/0319684 | A1 * | 12/2013 | Moellendick | E21B 17/1057 166/378 |
| 2016/0290069 | A1 * | 10/2016 | Chen | E21B 12/04 |

FOREIGN PATENT DOCUMENTS

| | | | | |
|---|---|---|---|---|
| CN | 103233683 | | 8/2013 | |
| EP | 0707131 | | 4/1996 | |
| GB | EP 0333450 | A1 * | 9/1989 | E21B 4/003 |
| GB | 2302143 | A * | 1/1997 | B65G 39/025 |
| GB | WO 0198622 | A1 * | 12/2001 | E21B 17/1057 |

* cited by examiner

DOWNHOLE DRILLING TOOLS INCLUDING LOW FRICTION GAGE PADS WITH ROTATABLE BALLS POSITIONED THEREIN

RELATED APPLICATION

This application is a U.S. National Stage Application of International Application No. PCT/US2013/075043 filed Dec. 13, 2013, which designates the United States, and which is incorporated herein by reference in its entirety.

TECHNICAL FIELD

The present disclosure is related to downhole drilling tools and more particularly to downhole drilling tools including low friction gage pads with rotatable balls positioned therein.

BACKGROUND

Various types of rotary drill bits, reamers, stabilizers and other downhole tools may be used to form a borehole in the earth. Examples of such rotary drill bits include, but are not limited to, fixed cutter drill bits, drag bits, polycrystalline diamond compact (PDC) drill bits, matrix drill bits, roller cone drill bits, rotary cone drill bits and rock bits used in drilling oil and gas wells. Cutting action associated with such drill bits generally requires weight on bit (WOB) and rotation of associated cutting elements into adjacent portions of a downhole formation. Drilling fluid may also be provided to perform several functions including washing away formation materials and other downhole debris from the bottom of a wellbore, cleaning associated cutting elements and cutting structures and carrying formation cuttings and other downhole debris upward to an associated well surface.

Rotary drill bits may be formed with blades extending from a bit body with respective gage pads disposed proximate the uphole edges of the blades. Exterior portions of such gage pads may be generally disposed approximately parallel with an associated bit rotational axis and adjacent portions of a straight wellbore. Gage pads may help maintain a generally uniform inside diameter of the wellbore.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION

Embodiments of the present disclosure and its advantages are best understood by referring to FIGS. 1 through 10, where like numbers are used to indicate like and corresponding parts.

Various aspects of the present disclosure may be described with respect to rotary drill bit 100 as shown in FIGS. 1-4. Rotary drill bit 100 may also be described as fixed cutter drill bits. Various aspects of the present disclosure may also be used to design various features of rotary drill 100 bit for optimum downhole drilling performance, including, but not limited to, the number of blades or cutter blades, dimensions and configurations of each cutter blade, configuration and dimensions of cutting elements, the number, location, orientation and type of cutting elements, gages (active or passive), length of one or more gage pads, orientation of one or more gage pads, and/or configuration of one or more gage pads. Further, various computer programs and computer models may be used to design gage pads, compacts, cutting elements, blades and/or associated rotary drill bits in accordance with some embodiments of the present disclosure.

Figure 1:
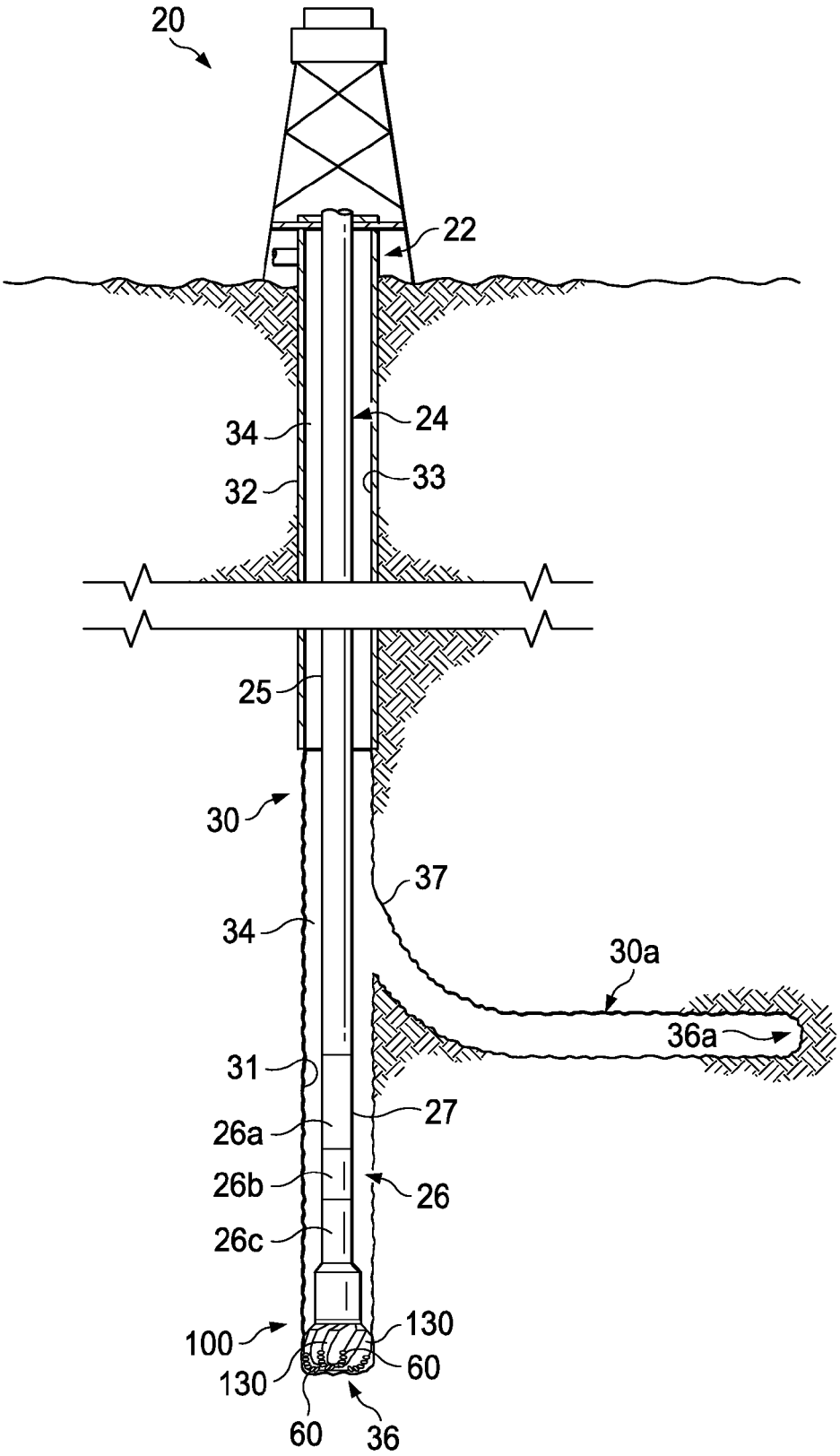
FIG. 1 is a schematic drawing in section and in elevation with portions broken away showing examples of wellbores which may be formed by a rotary drill bit in accordance with some embodiments of the present disclosure.

FIG. 1 illustrates an elevation view of an example embodiment of drilling system 100, in accordance with some embodiments of the present disclosure. Various aspects of the present disclosure may be described with respect to drilling rig 20, rotating drill string 24, and attached rotary drill bit 100, to form a wellbore.

Various types of drilling equipment such as a rotary table, mud pumps, and mud tanks (not expressly shown) may be located at well surface or well site 22. Drilling rig 20 may have various characteristics and features associated with a "land drilling rig." However, rotary drill bits incorporating teachings of the present disclosure may be satisfactorily used with drilling equipment located on offshore platforms, drill ships, semi-submersibles and drilling barges (not expressly shown).

For some applications rotary drill bit 100 may be attached to bottom hole assembly 26 at an end of drill string 24. The term "rotary drill bit" may be used in this application to include various types of fixed cutter drill bits, drag bits, matrix drill bits, steel body drill bits, roller cone drill bits, rotary cone drill bits, and rock bits operable to form a wellbore extending through one or more downhole formations. Rotary drill bits and associated components formed in accordance with some embodiments of the present disclosure may have many different designs, configurations and/or dimensions.

Drill string 24 may be formed from sections or joints of a generally hollow, tubular drill pipe (not expressly shown). Bottom hole assembly 26 will generally have an outside diameter compatible with exterior portions of drill string 24.

Bottom hole assembly 26 may be formed from a wide variety of components. For example components 26*a*, 26*b* and 26*c* may be selected from the group including, but not limited to, drill collars, near bit reamers, bent subs, stabilizers, rotary steering tools, directional drilling tools and/or downhole drilling motors. The number of components such as drill collars and different types of components included in a bottom hole assembly may depend upon anticipated downhole drilling conditions and the type of wellbore which will be formed by drill string 24 and rotary drill bit 100.

Drill string 24 and rotary drill bit 100 may be used to form a wide variety of wellbores and/or bore holes such as generally vertical wellbore 30 and/or generally horizontal wellbore 30*a* as shown in FIG. 1. Various directional drilling techniques and associated components of bottom hole assembly 26 may be used to form horizontal wellbore 30*a*. For example lateral forces may be applied to rotary drill bit 100 proximate kickoff location 37 to form horizontal wellbore 30*a* extending from generally vertical wellbore 30. Such lateral movement of rotary drill bit 100 may be described as "building" or forming a wellbore with an increasing angle relative to vertical. Bit tilting may also occur during formation of horizontal wellbore 30*a*, particularly proximate kickoff location 37.

Wellbore 30 may be defined in part by casing string 32 extending from well surface 22 to a selected downhole location. Portions of wellbore 30, as shown in FIG. 1, which do not include casing 32, may be described as "open hole." Various types of drilling fluid may be pumped from well surface 22 through drill string 24 to attached rotary drill bit 100. The drilling fluid may be circulated back to well surface 22 through annulus 34 defined in part by outside diameter 25 of drill string 24 and sidewall 31 of wellbore 30. Annulus 34 may also be defined by outside diameter 25 of drill string 24 and inside diameter of casing string 32.

The inside diameter of wellbore 30 (illustrated by sidewall 31) may often correspond with a nominal diameter or nominal outside diameter associated with rotary drill bit 100. However, depending upon downhole drilling conditions, the amount of wear on one or more components of a rotary drill bit, and variations between nominal diameter bit and as build dimensions of a rotary drill bit, a wellbore formed by a rotary drill bit may have an inside diameter which may be either larger than or smaller than the corresponding nominal bit diameter. Therefore, various diameters and other dimensions associated with gage pads formed in accordance with teachings of the present disclosure may be defined with respect to an associated bit rotational axis and not the inside diameter of a wellbore formed by an associated rotary drill bit.

Formation cuttings may be formed by rotary drill bit 100 engaging formation materials proximate end 36 of wellbore 30. Drilling fluids may be used to remove formation cuttings and other downhole debris (not expressly shown) from end 36 of wellbore 30 to well surface 22. End 36 may sometimes be described as "bottom hole" 36. Formation cuttings may also be formed by rotary drill bit 100 engaging end 36*a* of horizontal wellbore 30*a*.

As shown in FIG. 1, drill string 24 may apply weight to and rotate rotary drill bit 100 to form wellbore 30. The inside diameter of wellbore 30 (illustrated by sidewall 31) may correspond approximately with the combined outside diameter of blades 130 and associated gage pads 150 extending from rotary drill bit 100. Rate of penetration (ROP) of a rotary drill bit is typically a function of both weight on bit (WOB) and revolutions per minute (RPM). For some applications, a downhole motor (not expressly shown) may be provided as part of bottom hole assembly 26 to also rotate rotary drill bit 100. The rate of penetration of a rotary drill bit is generally stated in feet per hour.

In addition to rotating and applying weight to rotary drill bit 100, drill string 24 may provide a conduit for communicating drilling fluids and other fluids from well surface 22 to drill bit 100 at end 36 of wellbore 30. Such drilling fluids may be directed to flow from drill string 24 to respective nozzles provided in rotary drill bit 100. See for example nozzle 56 in FIG. 3.

Bit body 120 may be substantially covered by a mixture of drilling fluid, formation cuttings and other downhole debris while drilling string 24 rotates rotary drill bit 100. Drilling fluid exiting from one or more nozzles 56 may be directed to flow generally downwardly between adjacent blades 130 and flow under and around lower portions of bit body 120.

Figure 3:
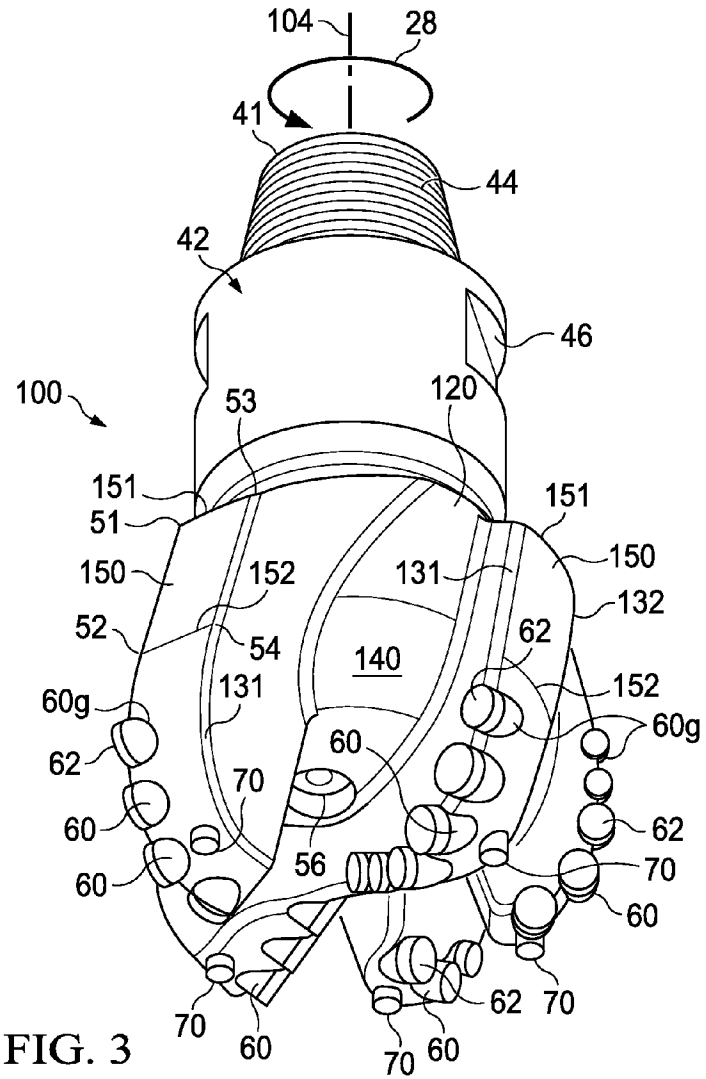
FIG. 3 is a schematic drawing showing an isometric view of another example of a rotary drill bit in accordance with some embodiments of the present disclosure.
Figure 2:
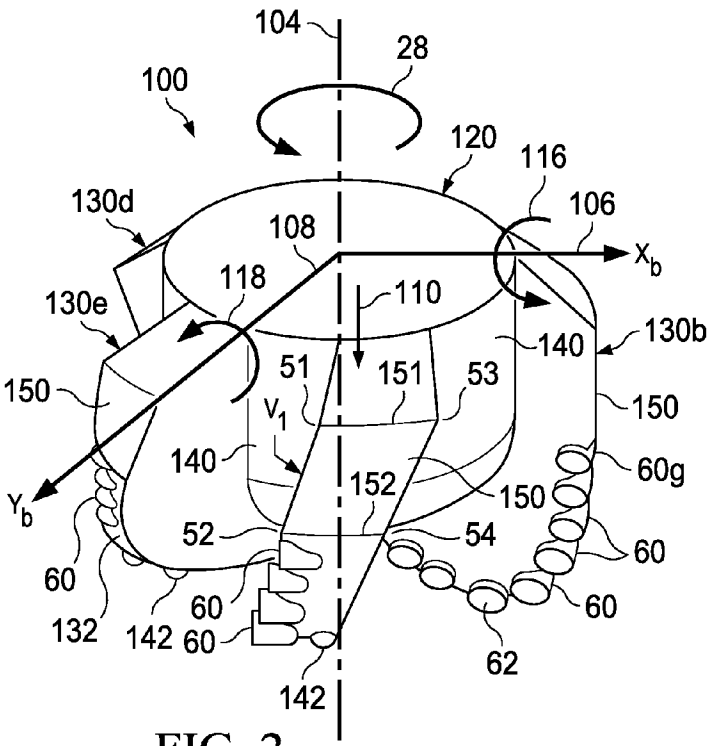
FIG. 2 is a schematic drawing showing an isometric view with portions broken away of a rotary drill bit in accordance with some embodiments of the present disclosure.

FIGS. 2 and 3 are schematic drawings showing additional details of rotary drill bit 100 which may include at least one gage, gage portion, gage segment, or gage pad in accordance with some embodiments of the present disclosure. The term "gage pad" as used in this application may include a gage, gage segment, gage portion or any other portion of a rotary drill bit, in accordance with some embodiments of the present disclosure. Rotary drill bit 100 may include bit body 120 with a plurality of blades 130 extending therefrom. For some applications, bit body 120 may be formed in part from a matrix of hard materials associated with rotary drill bits. For other applications bit body 120 may be machined from various metal alloys satisfactory for use in drilling wellbores in downhole formations.

Bit body 120 may also include upper portion or shank 42 with American Petroleum Institute (API) drill pipe threads 44 formed thereon. API threads 44 may be used to releasably engage rotary drill bit 100 with bottom hole assembly 26, whereby rotary drill bit 100 may be rotated relative to bit rotational axis 104 in response to rotation of drill string 24. Bit breaker slots 46 may also be formed on exterior portions of upper portion or shank 42 for use in engaging and disengaging rotary drill bit 100 from an associated drill string.

An enlarged bore or cavity (not expressly shown) may extend from end 41 through upper portion 42 and into bit body 120. The enlarged bore may be used to communicate drilling fluids from drill string 24 to one or more nozzles 56. A plurality of respective junk slots or fluid flow paths 140 may be formed between respective pairs of blades 130.

Blades 130 may spiral or extend at an angle relative to associated bit rotational axis 104.

A plurality of cutting elements 60 may be disposed on exterior portions of each blade 130. For some applications each cutting element 60 may be disposed in a respective socket or pocket formed on exterior portions of associated blades 130. Impact arrestors and/or secondary cutters 70 may also be disposed on each blade 130. See for example, FIG. 3. The terms "cutting element" and "cutting elements" may be used in this application to include, but are not limited to, various types of cutters, compacts, buttons, inserts and gage cutters satisfactory for use with a wide variety of rotary drill bits. Impact arrestors may be included as part of the cutting structure on some types of rotary drill bits and may sometimes function as cutting elements to remove formation materials from adjacent portions of a wellbore. Polycrystalline diamond compacts (PDC) and tungsten carbide inserts are often used to form cutting elements. Such tungsten carbide inserts may include, but are not limited to, monotungsten carbide (WC), ditungsten carbide ($W_2C$), macrocrystalline tungsten carbide, and cemented or sintered tungsten carbide. Various types of other hard, abrasive materials may also be satisfactorily used to form cutting elements.

Cutting elements 60 may include respective substrates (not expressly shown) with respective layers 62 of hard cutting material disposed on one end of each respective substrate. Layer 62 of hard cutting material may also be referred to as "cutting layer" 62. Each substrate may have various configurations and may be formed from tungsten carbide or other materials associated with forming cutting elements for rotary drill bits. For some applications cutting layers 62 may be formed from substantially the same hard cutting materials. For other applications cutting layers 62 may be formed from different materials.

Various parameters associated with rotary drill bit 100 may include, but are not limited to, location and configuration of blades 130, junk slots 140, and cutting elements 60. Each blade 130 may include respective gage portion or gage pad 150. For some applications, gage cutters may also be disposed on each blade 130. See for example gage cutters 60*g*.

Figure 4:
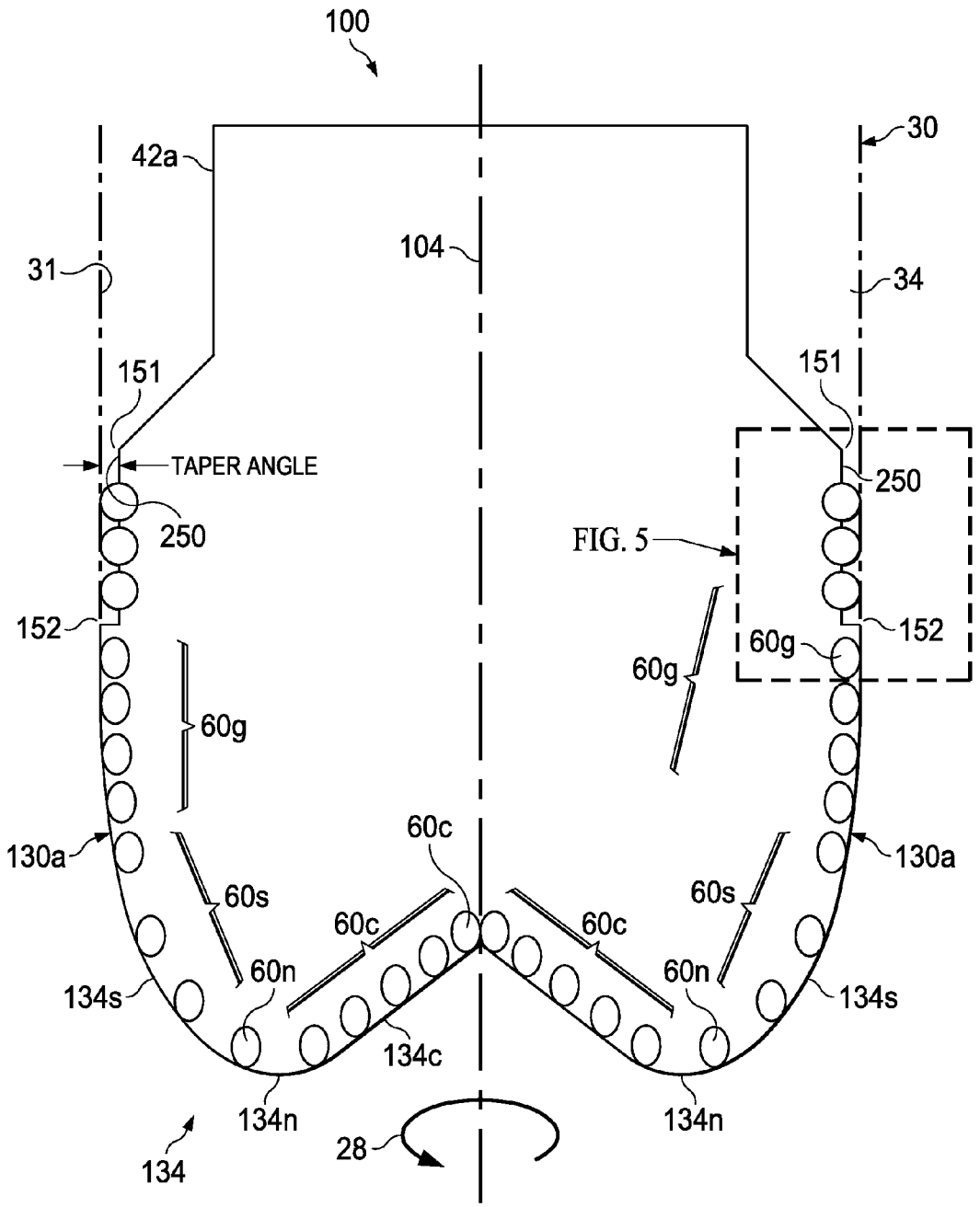
FIG. 4 is a schematic drawing in section with portions broken away showing still another example of a rotary drill bit in accordance with some embodiments of the present disclosure.

FIG. 4 is a schematic drawing in section with portions broken away showing an example of rotary drill bit 100. Rotary drill bit 100 as shown in FIG. 4 may be described as having a plurality of blades 130*a* with a plurality of cutting elements 60 disposed on exterior portions of each blade 130*a*. In some embodiments, cutting elements 60 may have substantially the same configuration and design. In other embodiments, various types of cutting elements and impact arrestors (not expressly shown) may also be disposed on exterior portions of blades 130*a*.

Exterior portions of blades 130*a* and associated cutting elements 60 may be described as forming a "bit face profile" for rotary drill bit 100. Bit face profile 134 of rotary drill bit 100, as shown in FIG. 4, may include recessed portions or cone shaped segments 134*c* formed on rotary drill bit 100 opposite from shank 42*a*. Each blade 130*a* may include respective nose portions or segments 134*n* which define in part an extreme end of rotary drill bit 100 opposite from shank 42*a*. Cone shaped segments 134*c* may extend radially inward from respective nose segments 134*n* toward bit rotational axis 104. A plurality of cutting elements 60*c* may be disposed on recessed portions or cone shaped segments 134*c* of each blade 130*a* between respective nose segments 134*n* and rotational axis 104*a*. A plurality of cutting elements 60*n* may be disposed on nose segments 134*n*.

Each blade 130*a* may also be described as having respective shoulder segment 134*s* extending outward from respective nose segment 134*n*. A plurality of cutting elements 60*s* may be disposed on each shoulder segment 134*s*. Cutting elements 60*s* may sometimes be referred to as "shoulder cutters." Shoulder segments 134*s* and associated shoulder cutters 60*s* may cooperate with each other to form portions of bit face profile 134 of rotary drill bit 100 extending outward from nose segments 134*n*.

A plurality of gage cutters 60*g* may also be disposed on exterior portions of each blade 130*a* proximate respective gage pad 250. Gage cutters 60*g* may be used to trim or ream sidewall 31 of wellbore 30.

As shown in FIG. 4, each blade 130*a* may include respective gage pad 250. Gage pads may be used to define or establish a generally uniform inside diameter of a wellbore formed by an associated rotary drill bit. The uniformity of the inside diameter of the wellbore may in turn contribute to the lateral stability of the drill bit by dampening any lateral vibration experienced by the drill bit.

Gage pad 250 may include uphole edge 151 disposed generally adjacent to an associated upper portion or shank. Gage pad 250 may also include a downhole edge 152. The terms "downhole" and "uphole" may be used in this application to describe the location of various components or features of a rotary drill bit relative to portions of the rotary drill bit which engage the bottom or end of a wellbore to remove adjacent formation materials. For example an "uphole" component or feature may be located closer to an associated drill string or bottom hole assembly as compared to a "downhole" component or feature which may be located closer to the bottom or end of the wellbore. In horizontal drilling applications, for example, a "downhole" component or feature may be located closer to the end of a wellbore as compared to an "uphole" component or feature, despite the fact that the two components or features may have similar vertical elevations.

Referring back to FIGS. 2 and 3, gage pad 150 may include leading edge 131 and trailing edge 132 extending downhole from associated uphole edge 151. Leading edge 131 of each gage pad 150 may extend from corresponding leading edge 131 of associated blade 130. Trailing edge 132 of each gage pad 150 may extend from corresponding trailing edge 132 of associated blade 130. Reference may also be made to four points or locations (51, 52, 53 and 54) disposed on exterior portions of gage pad 150. Point 51 may generally correspond with the intersection of respective uphole edge 151 and respective portions of leading edge 131. Point 53 may generally correspond with the intersection of respective uphole edge 151 and respective portions of trailing edge 132. Point 52 may generally correspond with the intersection of respective downhole edge 152 and respective portions of leading edge 131. Point 54 may generally correspond with respective downhole edge 152 and respective portions of trailing edge 132

As shown in FIG. 4, gage pad 250 may be configured to define or establish a generally uniform sidewall 31 of wellbore 30 formed by rotary drill bit 100. The uniformity of sidewall 31 may in turn contribute to the lateral stability of the drill bit 100 by dampening any lateral vibration experienced by drill bit 110*a*. Friction between gage pad 250 and sidewall 31 may cause a drag torque. Gage pad 250 may include one or more rotatable balls 255 in order to reduce the friction between gage pad 250 and sidewall 31. Accordingly, the presence of rotatable balls 255 may reduce stick-slip vibration associated with gage pad 250 and thus improve the overall stability of drill bit 100.

Figure 5A:
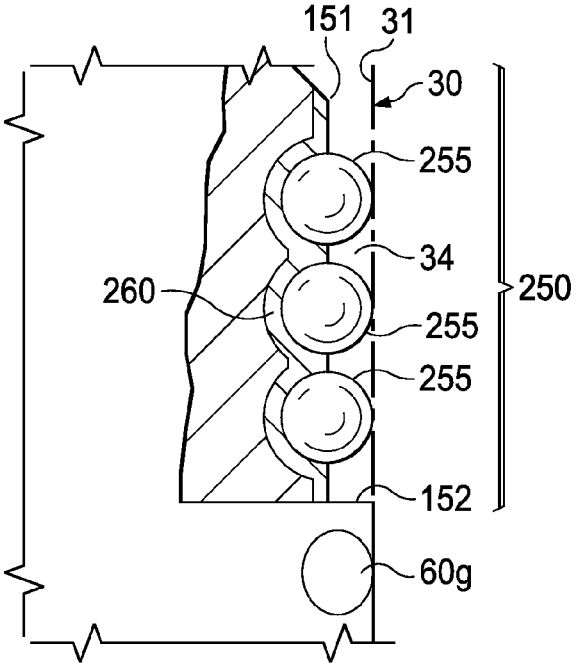
FIG. 5A is a schematic drawing in section with portions broken away showing an enlarged view of a gage pad of one blade on a rotary drill bit in accordance with some embodiments of the present disclosure.

FIG. 5A is a schematic drawing in section with portions broken away showing an enlarged view of a gage portion of a blade on a rotary drill bit. As shown in FIG. 5A, gage pad 250 may be located above the upper most gage cutter 60*g* of a blade. Gage pad 250 may include one or more rotatable balls 255. Rotatable balls 255 may be held in place by ball retainer 260. In some embodiments, ball retainer 260 may a recess or a concave cutout in gage pad 250 that is configured to receive rotatable ball 255. In other embodiments, gage pad 250 may include a hole to receive rotatable ball 255 and a recess or a concave cutout may be formed in the bit body of a downhole drilling tool (e.g., bit body 120 of drill bit 101 as illustrated in FIGS. 1 through 3). The hole in gage pad 250 and the recess or concave cutout may cooperate to form ball retainer 260.

As described in further detail below with reference to FIG. 9, ball retainer 260 may partially enclose rotatable ball 255 such that rotatable ball has an exposure that is less than the radius of rotatable ball 255. Further, ball retainer 260 may include any suitable low-friction coating, which may reduce friction between ball retainer 260 and rotatable ball 255. In some embodiments, the a low-friction coating may have an imbricate structure which may be formed by placing platelet-like solid-state lubricants and platelet-like particles in a binder. Examples of low-friction coatings for use with the present disclosure may include low-friction, heat-stable or heat-resistant polymers such as polytetrafluoroethylene (PTFE), including both filled and unfilled PTFE, and/or materials developed by INM—Leibniz Institute for New Materials in Saarbriicken, Germany (see http://www.inm-gmbh.de/en/2012/04/low-friction-coating-and-corrosion-protection-nanocomposite-material-with-double-effect-2/). With the low-friction coating, ball retainer 260 may maintain the position of rotatable ball 255 within the partial enclosure of ball retainer 260, while also allowing rotatable ball 255 to rotate freely in any direction within ball retainer 260 when subjected to a tangential force in any direction. The motion at gage pad 250 during drilling may be a spiral motion due to the combination of the rotational movement of drill bit 100 about bit rotational axis 104 and the downhole movement experienced as drill bit 100 proceeds downhole during drilling. Thus, rotatable balls 255 may rotate within ball retainer 260 at an angle corresponding to the spiral motion of gage pad 250. As a result of the rotation of rotatable ball 255, friction between gage pad 250 and sidewall 31 may be reduced, stick-slip vibration may be minimized, and the overall stability of drill bit 100 may be improved.

Figure 5B:
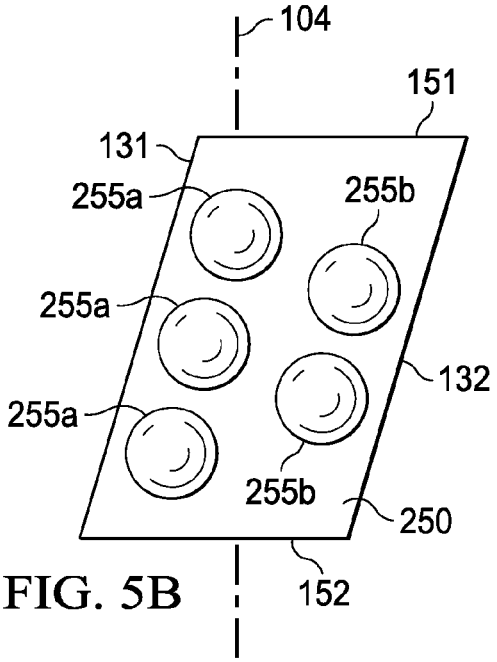
FIG. 5B is a schematic drawing showing an isometric side view of a gage pad of FIG. 5A in accordance with some embodiments of the present disclosure.

FIG. 5B is a schematic drawing showing an isometric side view of gage pad 250 in FIG. 5A. Referring back to FIG. 2, blade 130*a* may spiral or extend at an angle relative to bit rotational axis 104. Accordingly, gage pad 150 shown in FIG. 2 may extend from downhole edge 152 to uphole edge 151 at an angle that may follow the angle of blade 130*a* relative to bit rotational axis 104. Similar to gage pad 150 in FIG. 2, gage pad 250 in FIG. 5B may be located on a blade (not expressly shown) that may spiral or extend at an angle relative to bit rotational axis 104. Thus, as shown in FIG. 5B, gage pad 250 may extend from downhole edge 152 to uphole edge 151 at an angle relative to bit rotational axis 104.

Gage pad 250 may include any suitable number of rotatable balls 255 arranged in any suitable manner between downhole edge 152 and uphole edge 151, and between leading edge 131 and trailing edge 132. For example, a first plurality of rotatable balls 255*a* may be arranged in a first angled column extending from uphole edge 151 to downhole edge 152. Such an angled column of rotatable balls 255 may follow the angle of gage pad 250 relative to bit rotational axis 104. A second plurality of rotatable balls 255*b* may be arranged in a second angled column that may extend from uphole edge 151 to downhole edge 152. The second angled column of rotatable balls 255*b* may be adjacent to the first angled column of rotatable balls 255*a*. In some embodiments, rotatable balls 255*b* may be located at heights (as measured from downhole edge 152 toward uphole edge 151 on an axis parallel to bit rotational axis 104) that are offset from the locations of rotatable balls 255*a*, such that there is a consistent distribution of rotatable balls 255 from downhole edge 152 to uphole edge 151.

Although rotatable balls 255*a* and 255*b* are described above as being disposed in ball retainers 260 on gage pad 250 in two angled columns, rotatable balls 255 may be disposed on gage pad 250 in any other suitable pattern. For example, in some embodiments, gage pad 250 may include a single rotatable ball 255. In other embodiments, gage pad 250 may include any number of columns (e.g., one, two, three, five, ten, or more) of rotatable balls 255 extending from downhole edge 152 to uphole edge 151, or any suitable number of rows (e.g., one, two, three, five, ten, or more) of rotatable balls 255 extending from leading edge 131 to trailing edge 132. Such rows and/or columns may each include any suitable number of rotatable balls 255 (e.g., one, two, three, five, ten, or more). In some embodiments, each rotatable ball 255 may be located at a unique height (as measured from downhole edge 152 toward uphole edge 151 on an axis parallel to bit rotational axis 104), while in other embodiments, two or more rotatable balls 255 may located at the same height.

Figure 6A:
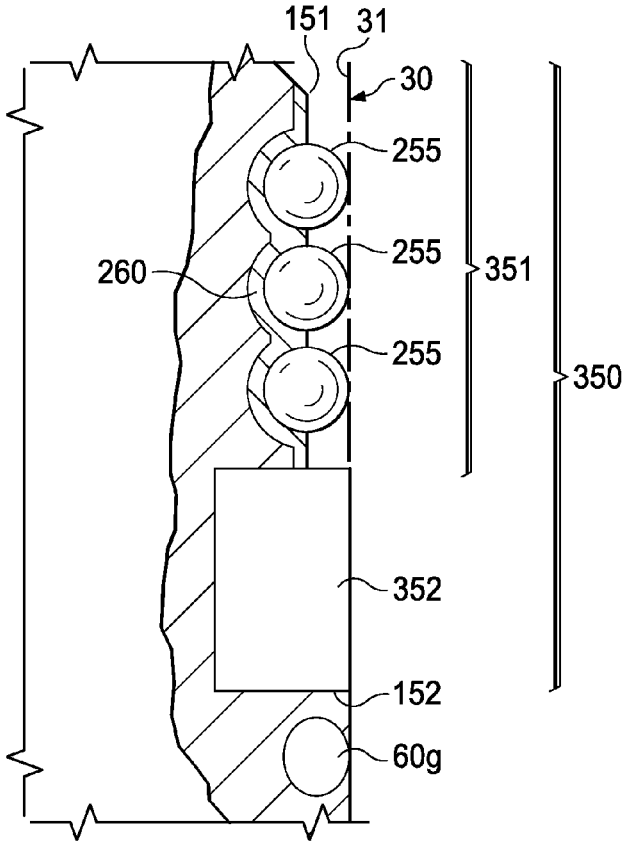
FIG. 6A is a schematic drawing in section with portions broken away showing an enlarged view of a gage pad of one blade on a rotary drill bit in accordance with some embodiments of the present disclosure.

FIG. 6A is a schematic drawing in section with portions broken away showing an enlarged view of a gage pad of one blade on a rotary drill. As shown in FIG. 6A, gage pad 350 may be located above the upper most gage cutter 60*g* of a blade. The length of gage pad 350 from downhole edge 152 to uphole edge 151 may affect the uniformity of sidewall 31 of wellbore 30 illustrated in FIG. 1. For example, the use of gage pads with longer lengths from the downhole edge 152 to the uphole edge 151 may result in increased uniformity of sidewall 31. In some drilling applications, a gage pad with a length of, for example, up to six inches or longer from the downhole edge to the uphole edge, may be utilized to achieve a high degree of wellbore quality (e.g., high uniformity of sidewall 31).

Directional drilling applications and/or horizontal drilling applications may utilize drill bits having elongated gage pads, such as gage pad 350 shown in FIG. 6A, in order to improve the uniformity of a sidewall (e.g., sidewall 31 of wellbore 30 as illustrated in FIG. 1). During drilling operations, gage pad 350 may experience rotational friction due to the interaction between gage pad 350 and sidewall 31 as the drill bit rotates about the bit rotational axis. During horizontal drilling, where the gravitational pull of the earth may be approximately perpendicular to the rotational axis of the drill bit, the weight of the drill bit may contribute to the interaction between gage pad 350 and sidewall 31, and as a result, may contribute to the rotational friction experienced by gage pad 350. The weight of the drill bit may similarly contribute to the rotational friction experienced by gage pad 350 during directional drilling. Such friction between gage pad 350 and sidewall 31 may be reduced by rotatable balls 255 disposed on gage pad 350. Accordingly, stick-slip vibration may be reduced, and the overall stability of the drill bit may be increased in such horizontal drilling applications.

In some embodiments, gage pad 350 may include multiple portions and friction-reducing rotatable balls 255 may be placed in ball retainers 260 on one or more portions of gage pad 350 that would otherwise experience the largest amount of rotational friction. For example, gage pad 350 may include downhole portion 352 extending from downhole edge 152 to midline 153, and uphole portion 351 extending from midline 153 to uphole edge 151. Downhole portion 352 may be configured with any suitable height compared to uphole portion 351, and thus midline 153 may be located at any position between downhole edge 152 and uphole edge 151.

During directional drilling operations, uphole portion 351 of gage pad 350 may experience more rotational friction than downhole portion 352. Thus, in some embodiments, downhole portion 352 may include a surface formed by a hard-faced, low-friction material, but may be configured to interact with the sidewall of a wellbore (e.g., sidewall 31 of wellbore 30 as illustrated in FIG. 1) without the friction-reducing rotatable balls 255. In such embodiments, rotatable balls 255 may, however, be disposed on uphole portion 351 of gage pad 350 in order to reduce the level of rotational friction in the portion of gage pad 350 that would otherwise experience the highest level rotational friction.

Figure 6B:
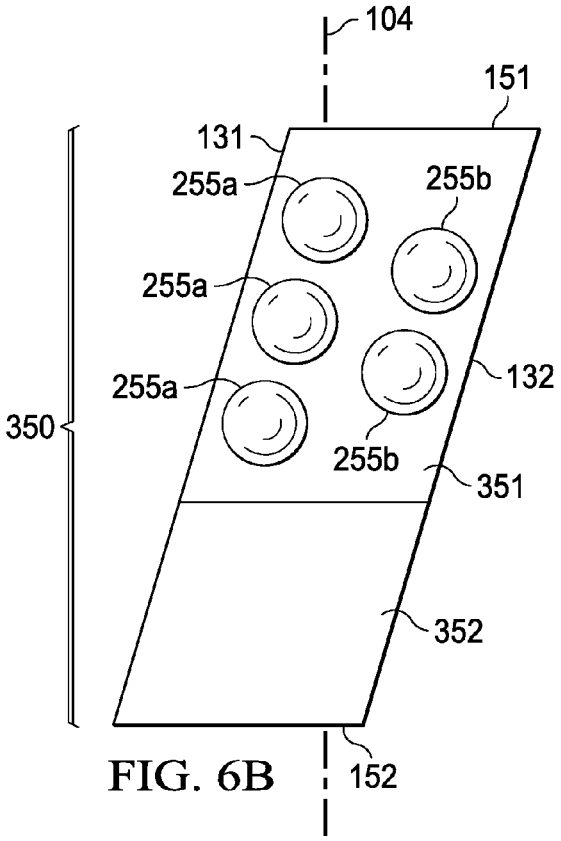
FIG. 6B is a schematic drawing showing an isometric side view of a gage pad of FIG. 6A in accordance with some embodiments of the present disclosure.

FIG. 6B is a schematic drawing showing an isometric side view of gage pad 250 in FIG. 6A. Referring back to FIG. 2, blade 130*a* may spiral or extend at an angle relative to bit rotational axis 104. Accordingly, gage pad 150 shown in FIG. 2 may extend from downhole edge 152 to uphole edge 151 at an angle that may follow the angle of blade 130*a* relative to bit rotational axis 104. Similar to gage pad 150 in FIG. 2, gage pad 350 in FIG. 6B may be located on a blade (not expressly shown) that may spiral or extend at an angle relative to bit rotational axis 104. Thus, as shown in FIG. 5B, gage pad 250 may extend from downhole edge 152 to uphole edge 151 at an angle relative to bit rotational axis 104.

Gage pad 350 may include any suitable number of rotatable balls 255 positioned in ball retainers 260 and arranged in any suitable manner in the uphole portion 351 of gage pad 350. For example, a first plurality of rotatable balls 255*a* may be arranged in a first angled column extending from uphole edge 151 to midline 153. The angled column of rotatable balls 255 may follow the angle of gage pad 250 relative to bit rotational axis 104. A second plurality of rotatable balls 255*b* may be arranged in a second angled column that may extend from uphole edge 151 to midline 153. The second angled column of rotatable balls 255*b* may be adjacent to the first angled column of rotatable balls 255*a*. In some embodiments, rotatable balls 255*b* may be located at heights (as measured from midline 153 toward uphole edge 151 on an axis parallel to bit rotational axis 104) that are offset from the locations of rotatable balls 255*a*, such that there is a consistent distribution of rotatable balls 255 from midline 153 to uphole edge 151.

Although rotatable balls 255*a* and 255*b* are described above as being disposed on uphole portion 351 in two angled columns, rotatable balls 255 may be disposed on uphole portion 351 of gage pad 350 in any other suitable pattern. For example, in some embodiments, uphole portion 351 may include a single rotatable ball 255. In some embodiments, uphole portion 351 may include any number of columns of rotatable balls 255 extending from midline 153 to uphole edge 151, or any suitable number of rows of rotatable balls 255 extending from leading edge 131 to trailing edge 132. Each row and/or column may each include any suitable number of rotatable balls 255. In some embodiments, each rotatable ball 255 may be located at a unique height (as measured from midline 153 toward uphole edge 151 on an axis parallel to bit rotational axis 104), while in other embodiments, two or more rotatable balls 255 may be located at the same height.

Figure 7A:
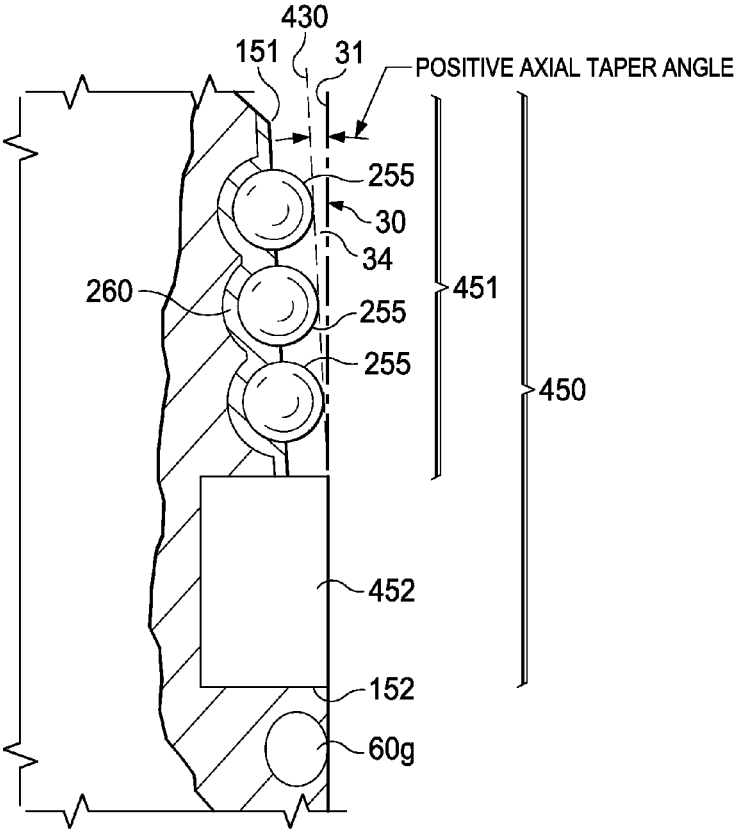
FIG. 7A is a schematic drawing in section with portions broken away showing an enlarged view of a gage pad of one blade on a rotary drill bit in accordance with some embodiments of the present disclosure.

FIG. 7A is a schematic drawing in section with portions broken away showing an enlarged view of a gage pad of one blade on a rotary drill bit. As shown in FIG. 7A, gage pad 450 may be located above the upper most gage cutter 60*g* of a blade. As described above, elongated gage pads, such as gage pad 450 may be utilized to improve wellbore quality (e.g., uniformity of sidewall 31 of wellbore 30 illustrated in FIG. 1).

In order to improve the steerability of a drill bit utilizing an elongated gage pad, such as gage pad 450, the uphole portion of the gage pad may be formed with a positive axial taper angle. The term "axial taper" may be used in this application to describe various portions of a gage pad disposed at an angle relative to an associated bit rotational axis. An axially tapered portion of a gage pad may also be disposed at an angle extending longitudinally relative to adjacent portions of a straight wellbore.

As shown in FIG. 7A, uphole portion 451 of gage pad 450 may be configured with a positive axial taper angle between sidewall 31 and taper axis 430. The positive axial taper may allow a drill bit that includes gage pad 450 to be more easily tilted and pointed at an angle as compared to the immediate uphole portion of wellbore 30 as illustrated in FIG. 1. The positive axial taper angle may be any angle suitable to increase the steerability of a drill bit while also contributing to the lateral stability of drill bit 100. In some embodiments the positive axial taper angle may be any angle from 0.0 to 2.0 degrees. In other embodiments, the positive axial taper angle may be any angle from 0.5 to 1.0 degrees.

During directional drilling, uphole portion 451 of gage pad 450 may experience more rotational friction than downhole portion 452. Thus, in some embodiments, downhole portion 452 of gage pad 450 may include a surface formed by a hard-faced, low-friction material, but may be configured to interact with the sidewall of a wellbore without the friction-reducing rotatable balls 255. In such embodiments, rotatable balls 255 may, however, be disposed on uphole portion 451 of gage pad 450 in order to reduce the level of rotational friction in the portion of gage pad 450 that would otherwise experience the highest level rotational friction.

Figure 7B:
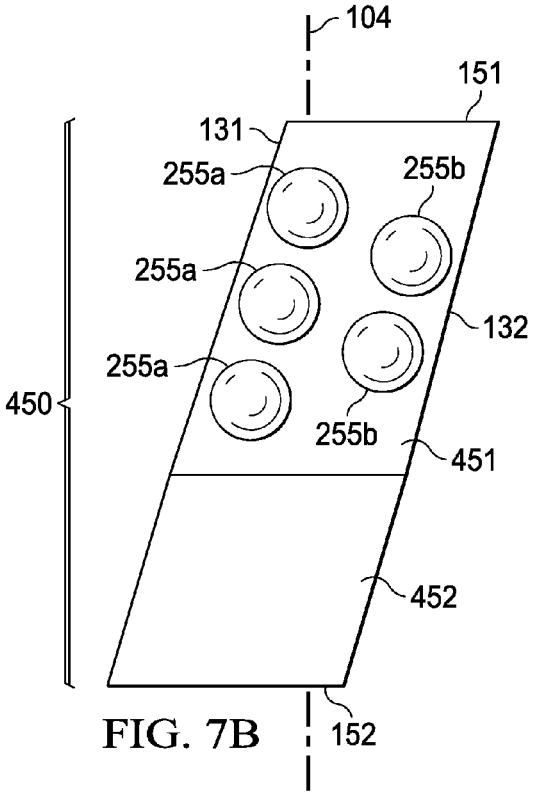
FIG. 7B is a schematic drawing showing an isometric side view of a gage pad of FIG. 7A in accordance with some embodiments of the present disclosure.

FIG. 7B is a schematic drawing showing an isometric side view of gage pad 450 in FIG. 7A. Referring back to FIG. 2, blade 130*a* may spiral or extend at an angle relative to bit rotational axis 104. Accordingly, gage pad 150 shown in FIG. 2 may extend from downhole edge 152 to uphole edge 151 at an angle that may follow the angle of blade 130*a* relative to bit rotational axis 104. Similar to gage pad 150 in FIG. 2, gage pad 450 in FIG. 7B may be located on a blade (not expressly shown) that may spiral or extend at an angle relative to bit rotational axis 104. Thus, as shown in FIG. 7B, gage pad 750 may extend from downhole edge 152 to uphole edge 151 at an angle relative to bit rotational axis 104. Because uphole portion 451 of gage pad 450 may have a positive axial taper (as shown in FIG. 7A), the radius of uphole edge 151 of gage pad 450 may be smaller than the radius of downhole edge 152 of gage pad 450.

Gage pad 450 may include any suitable number of rotatable balls 255 positioned in ball retainers 260 and arranged in any suitable manner in the uphole portion 451 of gage pad 450. For example, a first plurality of rotatable balls 255*a* may be arranged in a first angled column extending from uphole edge 151 to midline 153. Such an angled column of rotatable balls 255 may follow the angle of gage pad 250 relative to bit rotational axis 104. A second plurality of rotatable balls 255*b* may be arranged in a second angled column that may extend from uphole edge 151 to midline 153. The second angled column of rotatable balls 255*b* may be adjacent to the first angled column of rotatable balls 255*a*. In some embodiments, rotatable balls 255*b* may be located at heights (as measured from midline 153 toward uphole edge 151 on an axis parallel to bit rotational axis 104) that are offset from the locations of rotatable balls 255*a*, such that there is a consistent distribution of rotatable balls 255 from midline 153 to uphole edge 151.

Although rotatable balls 255*a* and 255*b* are described above as being disposed on uphole portion 451 in two angled columns, rotatable balls 255 may be disposed on uphole portion 451 of gage pad 450 in any other suitable pattern. For example, in some embodiments, uphole portion 451 may include a single rotatable ball 255. In some embodiments, uphole portion 451 may include any number of columns of rotatable balls 255 extending from midline 153 to uphole edge 151, or any suitable number of rows of rotatable balls 255 extending from leading edge 131 to trailing edge 132. Such rows and/or columns may each include any suitable number of rotatable balls 255. In some embodiments, each rotatable ball 255 may be located at a unique height (as measured from midline 153 toward uphole edge 151 on an axis parallel to bit rotational axis 104), while in other embodiments, two or more rotatable balls 255 may located at the same height.

As described above with reference to FIGS. 4 to 7B, gage pads may be disposed on a wide variety of rotary drill bits. Gage pads may also be disposed on other components of a bottom hole assembly and/or drill string. In some embodiments, gage pads may be disposed on rotating sleeves, non-rotating sleeves, reamers, stabilizers, and other downhole tools that may be associated with vertical, directional, and/or horizontal drilling systems. For example, a gage pad may be disposed on a blade of a BHA stabilizer, as described below with reference to FIG. 8.

Figure 8:
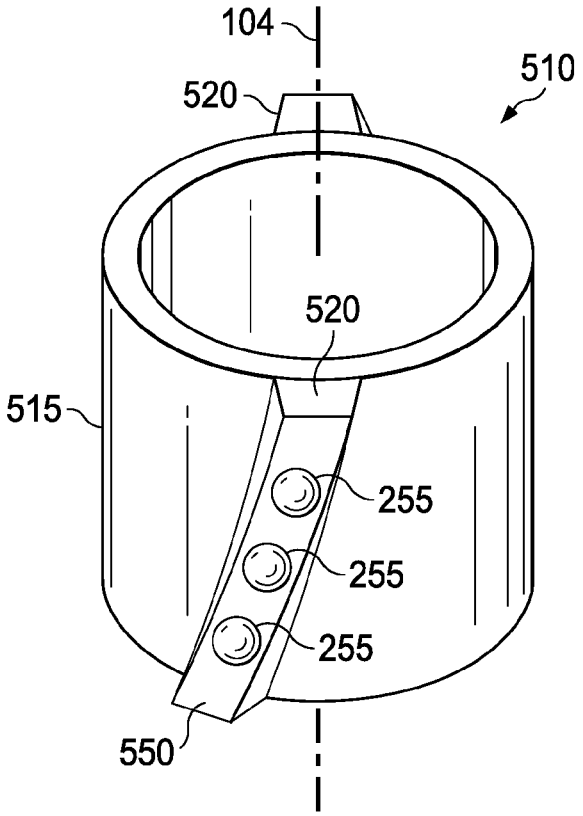
FIG. 8 is a schematic drawing showing an isometric view with portions broken away of a bottom hole assembly (BHA) stabilizer in accordance with some embodiments of the present disclosure.

FIG. 8 is a schematic drawing showing an isometric view with portions broken away of a bottom hole assembly (BHA) stabilizer. In some embodiments, bottom hole assembly 26 (shown in FIG. 1) may include BHA stabilizer 510 (shown in FIG. 8). BHA stabilizer 510 may include stabilizer body 515, blades 520, and gage pads 550. In some embodiments, blades 520 (and gage pads 550 located on outer portions thereof) may be configured to contact the sidewall of a wellbore in order to laterally stabilize a bottom hole assembly in the wellbore and to improve uniformity of the wellbore being drilled.

As shown in FIG. 8, gage pad 550 may be located on an outer portion of blade 520. Gage pad 550 may include one or more rotatable balls 255. Similar to rotatable balls 255 located on a gage pad of a drill bit (e.g., gage pads 250, 350, and 450, as described above with reference to FIGS. 4-7B), rotatable balls 255 may be held in place by a ball retainer (not expressly shown in FIG. 8). As described in further detail below with reference to FIG. 9, the ball retainer may partially enclose rotatable ball 255 such that rotatable ball has an exposure that is less than the radius of rotatable ball 255. Further, ball retainer 260 may include any suitable low-friction coating, which may reduce friction between ball retainer 260 and rotatable ball 255. With the low-friction coating, ball retainer 260 may partially enclose rotatable ball 255 in order maintain the position of rotatable ball 255 within ball retainer 260, while also allowing rotatable ball to rotate freely in any direction within ball retainer 260 when subjected to a tangential force in any direction. The motion at gage pad 550 during drilling may be a spiral motion due to the combination of the rotational movement of BHA stabilizer 510 about bit rotational axis 104 and the downhole movement experienced as BHA stabilizer 510 proceeds downhole during drilling. Thus, rotatable balls 255 may rotate within ball retainer 260 at an angle corresponding to the spiral motion of gage pad 550. As a result of the rotation of rotatable ball 255, friction between gage pad 550 and a sidewall of a wellbore being drilled may be reduced, stick-slip vibration may be minimized, and the overall stability of a drill string including BHA stabilizer 510 may be improved.

Figure 9:
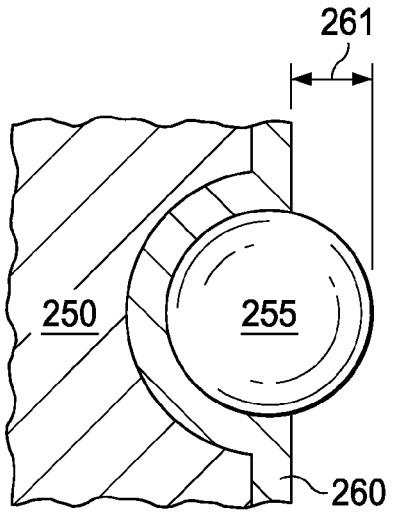
FIG. 9 is a schematic drawing in section with portions broken away showing an enlarged view of a rotatable ball of a gage pad of one blade on a rotary drill bit in accordance with some embodiments of the present disclosure.

FIG. 9 is a schematic drawing in section with portions broken away showing an enlarged view of a rotatable ball of a gage pad of one blade on a rotary drill bit in accordance with some embodiments of the present disclosure. As shown in FIG. 9, rotatable ball 255 may be supported by ball retainer 260. Ball retainer 260 may be affixed to, or may otherwise be a part of, gage pad 250. Although ball retainer 260 may be described as being affixed to, or being a part of gage pad 250, ball retainer 260 may be affixed to, or be a part of, any suitable gage pad (e.g., gage pads 350, 450, and 550 as described above with reference to FIGS. 6A-8).

Ball retainer 260 may partially enclose rotatable ball 255 such that rotatable ball 255 has an exposure 261 that is less than the radius of rotatable ball 255. For example, in some embodiments, exposure 261 may be any value greater than zero but less than one-half the radius of rotatable ball 255. Accordingly, the position of rotatable ball 255 may be held in place within ball retainer 260 when an exposed portion of rotatable ball 255 comes into contact with an adjacent portion of a sidewall of a wellbore. Further, ball retainer 260 may include any suitable low-friction coating, which may reduce friction between ball retainer 260 and rotatable ball 255. The low-friction coating of ball retainer 260 may allow rotatable ball 255 to rotate freely within the partial enclosure of ball retainer 260 despite the position of rotatable ball 255 being maintained within ball retainer 260 as rotatable ball 255 interacts with the sidewall of a wellbore during drilling. Because the exposed portion of rotatable ball 255 may rotate as that exposed portion interacts with the sidewall of a wellbore, the friction experienced between gage pad 250 and the sidewall of a wellbore may be reduced during drilling operations.

Rotatable ball 255 may be formed by any suitable wear-resistant material that may resist wear resulting from the interaction between rotatable ball 255 and the sidewall of a wellbore during drilling operations. For example, rotatable ball 255 may be formed by a polycrystalline diamond compact (PDC) material or a tungsten carbide material, including, but not limited to, monotungsten carbide (WC), ditungsten carbide ($W_2C$), macrocrystalline tungsten carbide, and cemented or sintered tungsten carbide.

Figure 10:
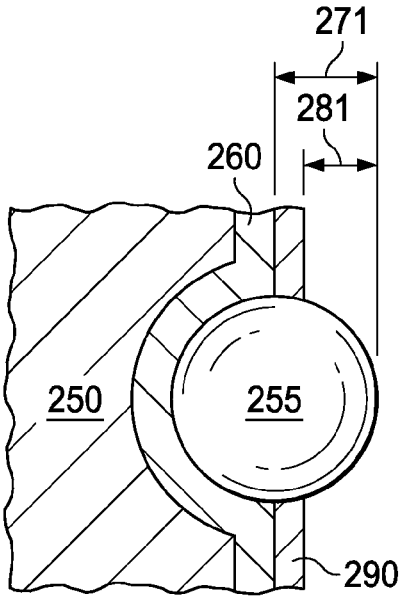
FIG. 10 is a schematic drawing in section with portions broken away showing an enlarged view of a rotatable ball of a gage pad of one blade on a rotary drill bit in accordance with some embodiments of the present disclosure.

FIG. 10 is a schematic drawing in section with portions broken away showing an enlarged view of a rotatable ball of a gage pad of one blade on a rotary drill bit. As shown in FIG. 10, rotatable ball 255 may be partially enclosed by ball retainer 260 and cover 290. As described above, ball retainer 260 may be affixed to, or may be a part of, gage pad 250. Cover 290 may be located on the outer edge of gage pad 250 and may act as a seal for ball retainer 260. For example, cover 290 may prevent dirt and rock from getting into the enclosure of ball retainer 260 during drilling operations. Thus, a consistent, low-friction interaction between ball retainer 260 and rotatable ball 255 may be maintained as rotatable ball 255 rotates within the partial enclosure of ball retainer 260.

In some embodiments, ball exposure 281 resulting from ball retainer 260 and cover 290 may be less than the radius of rotatable ball 255. However, in some embodiments, ball exposure 271 resulting from ball retainer 260 alone may be greater than the radius of rotatable ball 255. Further, cover 290 may be brazed or welded to the outer portion of gage pad 250 in such a manner that cover 290 may be removed.

Because ball exposure 281 may be less than the radius of rotatable ball 255, the position of rotatable ball 255 may be held in place relative to gage pad 250 when the exposed portion of rotatable ball 255 comes into contact with an adjacent portion of a sidewall of a wellbore during a drilling run. However, after drilling run has completed, cover 290 may be removed. Because ball exposure 271 may be greater than the radius of rotatable ball 255, rotatable ball 255 may also be removed when cover 290 is removed.

In some embodiments, rotatable ball 255 that is worn may be removed as described above after a first drilling run. The worn rotatable ball may be replaced by a new rotatable ball, and cover 290 may again be brazed or welded onto gage pad 250. Accordingly, ball retainer 260 may be re-sealed and new rotatable ball 255 may be held in place on gage pad 250 during a second drilling run. The replacement of one or more rotatable balls 255 on a gage pad 250 may coincide with the refurbishing of other components of a drill bit between drilling runs. For example, after the first drilling run described above, certain cutters 60 of drill bit 100 (shown in FIG. 3) may be replaced or re-covered (also referred to as being "re-padded") prior to a second drilling run. Accordingly, the useful life of drill bit 100 may be extended to multiple drilling runs.

Although ball retainer 260 and cover 290 may be described above as being implemented with rotatable ball 255 on gage pad 250, ball retainer 260 and cover 290 may be implemented with rotatable ball 255 on any suitable gage pad. For example, ball retainer 260 and cover 290, may be implemented with any of gage pads 350, 450, or 550 described above with reference to FIGS. 6A to 9.

Although the present disclosure has been described with several embodiments, various changes and modifications may be suggested to one skilled in the art. For example, although the present disclosure describes configurations of rotatable balls with respect to drill bits and BHA stabilizers, the same principles may be used to reduce friction experienced by components of any suitable drilling tool according to the present disclosure. It is intended that the present disclosure encompasses such changes and modifications as fall within the scope of the appended claims.

What is claimed is:

1. A downhole drilling tool, comprising:
a bit body;
a blade on an exterior portion of the bit body;
a gage pad on the blade, the gage pad including an uphole gage portion having a positive axial taper extending to an uphole edge of the gage pad;
a ball retainer in the gage pad; and
a ball located in the ball retainer such that an exposed portion of the ball is positioned to contact a wellbore and rotate in response to frictional engagement with the wellbore.

2. The downhole drilling tool of claim 1, wherein the ball is further positioned to rotate at an angle corresponding to a spiraling rotation of the gage pad.

3. The downhole drilling tool of claim 1, wherein the ball retainer is configured to maintain the position of the ball relative to the gage pad as the ball rotates.

4. The downhole drilling tool of claim 1, further comprising a cover disposed on an outer portion of the gage pad to provide a seal for the ball retainer and partially enclose the ball in order to maintain the position of the ball relative to the gage pad.

5. The downhole drilling tool of claim 4, wherein:
the cover is removable from the gage pad; and
the ball is removable from the gage pad if the cover has been removed.

6. The downhole drilling tool of claim 4, wherein the cover is brazed onto the gage pad.

7. The downhole drilling tool of claim 4, wherein the cover is welded onto the gage pad.

8. The downhole drilling tool of claim 1, wherein the ball comprises one of a polycrystalline diamond compact material or a tungsten carbide material.

9. A downhole drilling tool, comprising:
a bit body;
a blade on an exterior portion of the bit body; and
a gage pad on the blade, the gage pad including:
a downhole gage portion including a surface to contact adj acent portions of a wellbore; and
an uphole gage portion including a ball retainer and a ball located in the ball retainer such that an exposed portion of the ball is positioned to contact the wellbore and rotate in response to frictional engagement with the wellbore, the uphole gage portion having a positive axial taper extending to an uphole edge of the gage pad.

10. The downhole drilling tool of claim 9, wherein the ball is further positioned to rotate at an angle corresponding to a spiraling rotation of the gage pad.

11. The downhole drilling tool of claim 9, wherein the ball retainer is configured to maintain the position of the ball relative to the gage pad as the ball rotates.

12. The downhole drilling tool of claim 9, further comprising a cover disposed on an outer portion of the gage pad to provide a seal for the ball retainer and partially enclose the ball in order to maintain the position of the ball relative to the gage pad.

13. The downhole drilling tool of claim 12, wherein:
the cover is removable from the gage pad; and
the ball is removable from the gage pad if the cover has been removed.

14. The downhole drilling tool of claim 12, wherein the cover is brazed onto the gage pad.

15. The downhole drilling tool of claim 12, wherein the cover is welded onto the gage pad.

16. The downhole drilling tool of claim 12, wherein the ball comprises one of a polycrystalline diamond compact material or a carbide material.

* * * * *